United States Patent [19]

Rinehart

[11] 4,185,716

[45] Jan. 29, 1980

[54] SELF CLOSING GATE

[75] Inventor: Ronald A. Rinehart, Lancaster, Pa.

[73] Assignee: Ladder Towers, Inc., Lancaster, Pa.

[21] Appl. No.: 796,301

[22] Filed: May 12, 1977

[51] Int. Cl.[2] ..... E06C 7/16; E04G 1/26; B66B 13/00

[52] U.S. Cl. ..... 182/2; 182/113; 182/116

[58] Field of Search ..... 182/2, 113, 112, 63, 182/222, 116; 49/49, 50, 56; 160/136

[56] References Cited

U.S. PATENT DOCUMENTS

| | | | |
|---|---|---|---|
| 373,752 | 11/1887 | Perry | 160/143 |
| 696,559 | 4/1902 | Graham | 160/144 |
| 850,969 | 4/1907 | Rohrer | 160/136 |
| 1,165,782 | 12/1915 | Jones | 160/136 |
| 2,442,937 | 6/1948 | Roman | 160/144 |
| 3,727,722 | 4/1973 | Hedges | 182/2 |

FOREIGN PATENT DOCUMENTS

| | | | |
|---|---|---|---|
| 746282 | 3/1956 | United Kingdom | 182/66 |

*Primary Examiner*—Reinaldo P. Machado
*Attorney, Agent, or Firm*—Weiser, Stapler & Spivak

[57] ABSTRACT

An improved ladder supported rescue platform for use as an evacuation tool is disclosed. The platform includes a peripheral rail system wherein a gate can be raised vertically by a worker to enter the platform from the ladder or to enter the ladder from the platform. The geometry of the gate construction is designed to assure automatic closure without any action on the part of the user. The gate is designed of parallelogram configuration and may include a snaplock to secure the gate in its closed position.

5 Claims, 5 Drawing Figures

FIG. 1
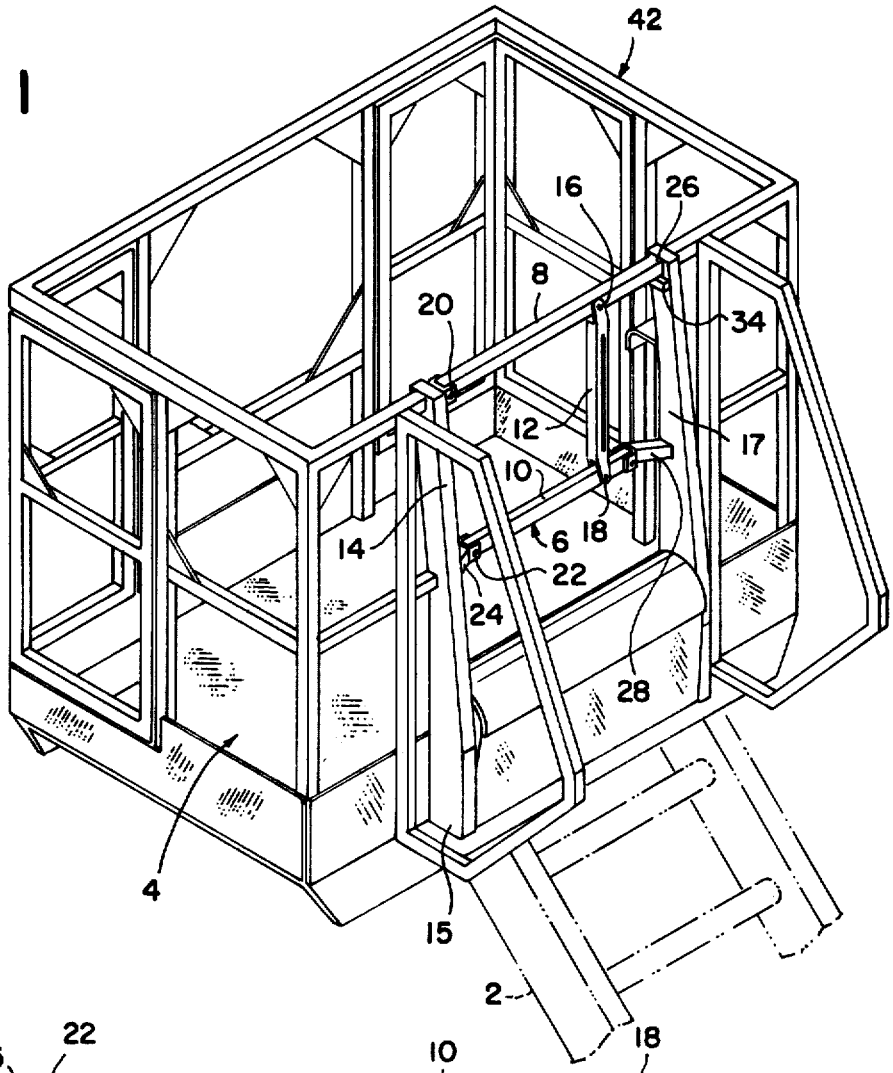
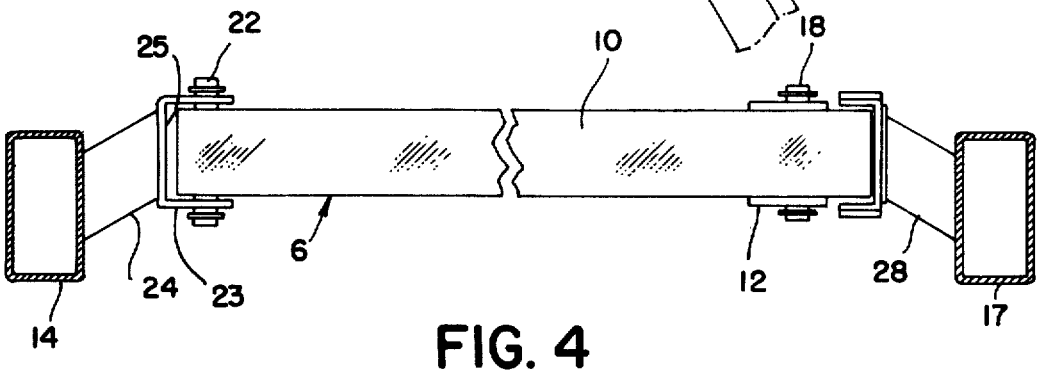
FIG. 4

SELF CLOSING GATE

BACKGROUND OF THE INVENTION

This invention relates to an improved ladder supported rescue platform in general, and more particularly, to a self closing gate forming a part of a platform peripheral rail system.

Boom elevated platforms are known in the prior art. Such platforms are used in various types of rescue operations and as work platforms to reach elevated job sites. Municipal fire departments have commonly utilized such platforms and wide employment of such equipment has been made when rescuing persons trapped in burning buildings and when fighting fires. Rescue platforms of this general type usually are associated with a boom equipped truck. Such apparatus most often is standard equipment in well equipped fire fighting companies. In use, the truck is positioned adjacent to the burning building and the rescue platform is approximately positioned by extending the boom. The fire fighters enter the rescue platform for performing the required tasks and then are lifted into the desired location by functioning the boom.

More recently, a basket platform has been associated directly with a hydraulically controlled ladder. In such use, it is imperative that the rescuer be able to ascend and enter the rescue platform easily, simply, and expeditiously. It is equally obvious that the rescue platform must be equipped with peripheral, sturdy side rails to prevent the rescuers, fire fighters and other persons from falling or being forced off of the elevated platform. The safety provided by the side rails is an important consideration, especially in the excitement and danger of an emergency situation wherein rapid and unexpected movements by persons occupying a rescue platform should be anticipated.

This problem increases as the number of persons on the platform increases. Accordingly, prior workers in the art have provided rescue platforms equipped with guide rails, or side walls or other peripherally enclosing constructions. Typical prior art ladder towers and ladder lifts with peripheral side rails have been designed by Ladder Towers, Incorporated, Lancaster, Pa. and sold under the trademark "LTI." Standards for construction of elevating platforms have been developed by governmental officials, fire departments, insurance carriers and others to assure adequate platform safety, especially with regard to guard railing. Pamphlet 1901 entitled "Automotive Fire Apparatus" published by the National Fire Protection Association is exemplary of such standards.

By seeking to enhance safety on and about the platform itself, the prior art designs have created another problem in that the railings themselves have impeded free access to the platform when a ladder was utilized. This has hindered rescue, fire fighting and other various operations from the platform. When a stationary peripheral side rail was employed, it was necessary for the worker to step over or under or through the railing when entering or leaving the platform. Efforts have been made to solve this problem by providing an entry gate in the platform railing. Some gates have been designed to swing directly into the platform with the obvious disadvantage that the gate itself becomes an obstacle to those on the platform. A gate so positioned also would require a person working on the platform to move at inopportune times when an additional worker attempts to enter the platform.

Other devices taught by the prior art have shown gates which swing outwardly from the platform. This type of gate presents a hazard to workers or fireman on the ladder in the vicinity of the platform. Outwardly swinging gates could easily cause persons entering the platform from the ladder to lose their balance and thereby increase the risk of falling from the ladder.

Notwithstanding the aforesaid problems associated with the horizontally swinging type of gate, such constructions are commonly used. Additionally, horizontally swinging gates must be secured in position after use either for entry or exiting. An improperly secured gate can inadvertently swing open if leaned upon, thereby creating the possibility of accident. The problem has not been the lack of adequate locking mechanisms, but rather, the human error in failure to properly use the locks. Further, the prior art gates have been manual in operation and have required the rescuer or operator to use conscious effort for opening and closing. This type of gate may be inadvertently left in an open position. In the active and excitement ridden atmosphere which exists in a situation when a rescue platform is being used, it is desirable that the most efficient and fail-proof mechanisms be provided.

SUMMARY OF THE INVENTION

The present invention solves the various problems associated with the prior art ladder tower platforms. The invention relates generally to a ladder supported rescue platform, and more specificially, to an improved gate therefor.

In the present invention, the platform is equipped with a peripheral railing having a gate positioned at the rear in alignment with the ladder so that entry or exit to and from the supporting ladder can be made. The gate, which forms a portion of the railing, is of parallelogram configuration wherein one of the vertical members forms part of one of the vertical support posts of the railing. The parallelogram is hinged at its four corners so that a simple manual upward motion by the operator will raise the gate. Due to its parallelogram design, the gate reduces its subscribed exposed surface area as it is raised towards the vertical position. When the lifting vertical force is removed, gravity causes the gate to resume automatically its normal closed position. Construction is provided to limit the pivotal upward swing of the gate to prevent overcentering. A snaplock can be provided as an additional safety device to prevent inadvertent upward movement of the gate without conscious effort by persons working on the platform.

Accordingly, it is an object of the present invention to provide a new and improved gate for use in combination with a ladder supported platform.

It is an object of the present invention to provide an improved self closing gate for a ladder supported platform which is vertically pivotal between open and closed positions.

It is another object of the invention to provide an improved self closing gate for a ladder supported platform which is statically stable and which is designed to automatically assume a closed position.

It is an additional object of the present invention to provide an improved self closing gate for a ladder supported platform which provides a partial safety barrier when raised to a partially open position.

It is an additional object of the present invention to provide an improved self closing gate for a ladder supported platform which forms a portion of the peripheral platform railing and which conveniently provides access therethrough.

It is another object of the present invention to provide a self closing gate for a ladder supported platform which includes a parallelogram configuration and wherein three sides of the parallelogram are movable.

It is another object of the present invention to provide a new and improved self closing gate for a ladder supported rescue platform which is swingable between open and closed positions by movement in a vertical plane.

It is another object of the present invention to provide a new and improved self closing gate for a ladder supported platform of design which reduces the exposed surface area when opened.

It is another object of this invention to provide a novel self closing gate that is inexpensive in construction, simple in operation and of reliable safety when in use.

Other objects and a fuller understanding of the invention will be had by referring to the following description and claims of a preferred embodiment thereof, taken in conjunction with the accompanying drawings, wherein like reference characters refer to similar parts through the several views, and in which:

BRIEF DESCRIPTION OF THE DRAWINGS

FIG. 1 is a perspective view of the invention showing the gate in closed position.

FIG. 4 is an enlarged, cross sectional view taken along line 4—4 of FIG. 2, looking in the direction of the arrows.

DESCRIPTION OF THE PREFERRED EMBODIMENT

Figure 2:
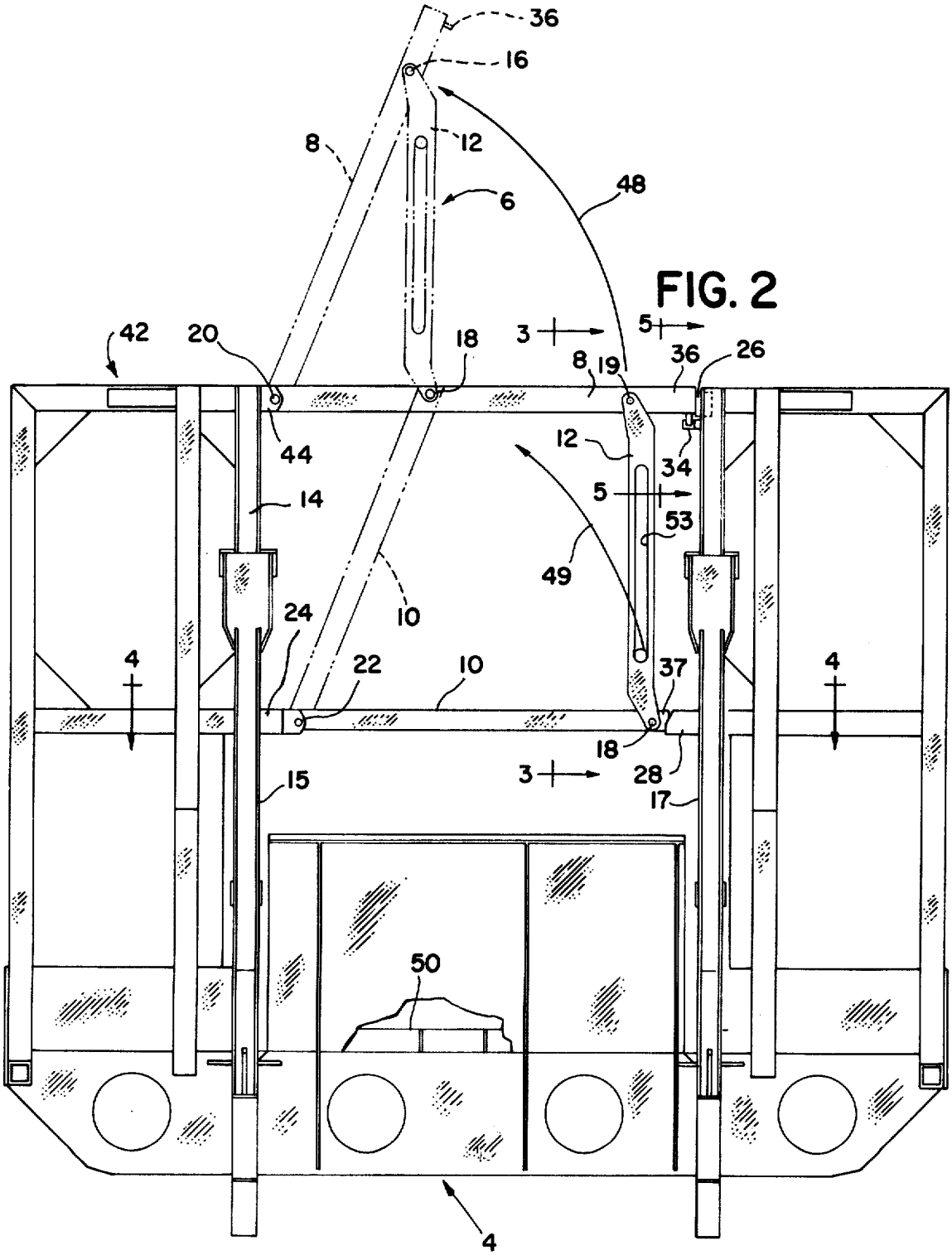
FIG. 2 is an enlarged, rear elevation view of the invention, partly broken away, showing the gate in its closed position and depicting the gate in phantom lines in a partially open position.

Although specific terms are used in the following description for the sake of clarity, these terms are intended to refer only to the particular structure of the invention selected for illustration in the drawings and are not intended to define or limit the scope of the invention.

Referring now to the drawings there is shown in FIG. 1 a ladder 2 of conventional design for the purpose carrying a ladder supported rescue platform 4. A gate 6 is illustrated forming a part of a peripheral rail system 42. As hereinafter more fully set forth, the gate 6 manually pivots upwardly to provide access through the rail system and is automatically pivotal downwardly by gravity to close the access opening.

In FIG. 2 it may be seen that the gate 6 is constructed to a parallelogram configuration. The gate configuration comprises a movable upper rail 8, a movable lower rail 10, a movable vertical member 12 and a stationary vertical member 14. The stationary vertical member 14 can form an integral portion of a primary support post 15 of the rescue platform 4.

Still referring to FIG. 2, it will be observed that the lower rail 10 connects to the stationary vertical member 14 through a horizontal offset link 24 in a pivotal connection 22. The pivotal connection 22 is horizontally inwardly displaced from the stationary vertical member 14 by distance equal to at least the height or thickness of the upper rail 8. The horizontal displacement of the hinge 22 permits the gate to be raised to a substantial vertical position without the upper rail 8 and the lower rail 10 contacting and binding upon each other. As illustrated, the upper rail 10 connects to the vertical member 14 through a short lug 44 and is pivotal about the upper hinge 20.

The system is designed to prevent the rails 8, 10 from reaching the full vertical position whereby there always will be an unbalanced force tending to close the gate. The lug 44 is shorter than the link 24 to thereby position the upper and lower hinges 20, 22 in different vertical planes. The horizontal offset of the hinges 20 and 22 facilitates vertical pivotal movement of the gate 6 without binding or contact between the horizontal legs 8, 10.

As illustrated in FIG. 4, the gate 6 is supported from the vertical posts 14, 17 in offset relationship by the offset link 24 and the offset stationary rail member 28. A channel shaped support 23 is welded or otherwise affixed to the link 24 to provide a secure attachment for the hinge pin 22. If desired, the top of the web 25 can be equipped with an inwardly projecting abutment or otherwise treated to upwardly limit the pivotal movement of the rail 10 about the lower hinge pin 22. In this manner, the arc of travel of the rails 8, 10 can be limited to less than ninety degrees, thereby preventing overcentering and always assuring gravity return to the closed position. By thus limiting the arc of travel, the center of gravity of the forces tending to close the gate will always be further from the pin 22 than the longitudinal axis of the gates. In this manner, forces of gravity continuously act to close the gate 6.

Figure 3:
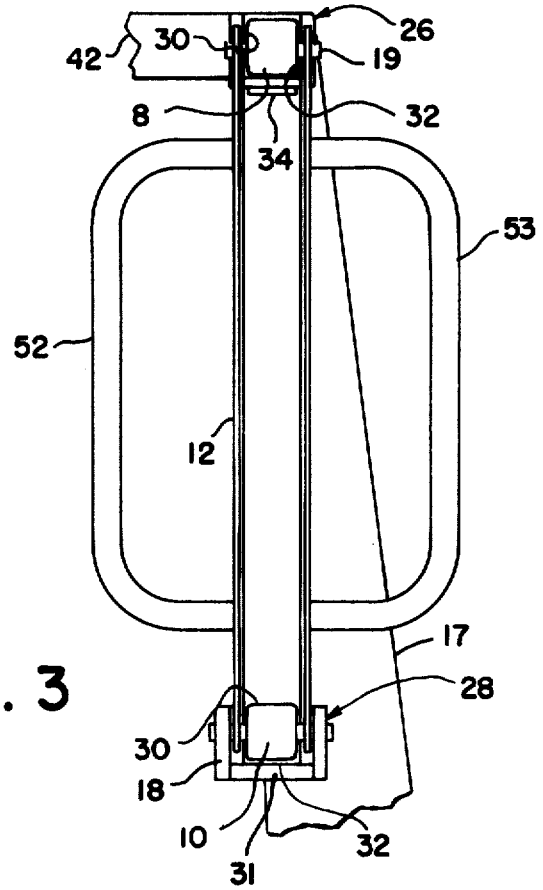
FIG. 3 is an enlarged, cross sectional view taken along line 3—3 of FIG. 2, looking in the direction of the arrows.

The movable ends 36, 37 of upper and lower rails 8 and 10 abut stationary members 34, 28 of the rescue platform 4 when the gate 6 is closed. The upper rail end projection 36 engages the rail 26 at the locking mechanism 34. The lower free end 37 engages and stops upon the stationary rail 28. As may be better seen in FIG. 3 the upper and lower rail extremities 36, 37 respectively rest upon the lock mechanism 34 and the web 31 of the lower rail 28 which serve as stops to positively position the gate 6 in its closed position. As illustrated, upper and lower rails respectively position intermediate the left and right flanges 30, 32 of the vertical gate member 12.

Figure 5:
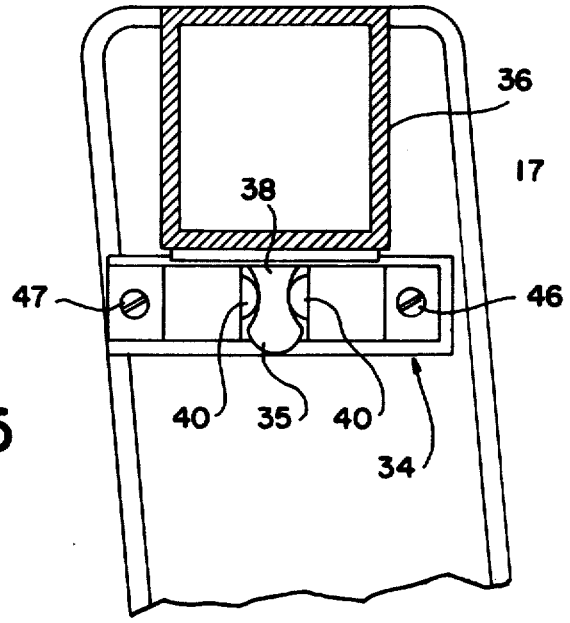
FIG. 5 is an enlarged, detail view of the locking mechanism.

The gate 6 is provided with a lock mechanism 34 which is shown in detail in FIG. 5. The lock 34 may comprise a downwardly protruding tongue or projection 35 which depends from upper rail extremity 36. The projection 35 includes a constricted neck portion 38 which is engaged by the opposed members 40 of the snaplock. The members 40 may be forced together by a spring or other construction (not shown) in well known manner. It may thus be seen that a positive upward force is required to disengage the downwardly projecting tongue 35 from the spring detents 40 to allow the gate to move to the open position illustrated in phantom lines in FIG. 2. The lock mechanism 34 may be secured to the vertical support post 17 in conventional manner, such as by employing threaded fasteners 46, 47. It will be appreciated that one type of gate locking system has been illustrated in detail for purposes of explanation. However, other locking devices suitable for the intended use could also be employed with equal facility and still fall within the meaning and scope of this invention.

In operation, rescue personnel can enter the rescue platform 4 by climbing the ladder 2 and then manually raising the gate 6. A manual force upon gate 6 directed upwardly causes the gate to become disengaged from the lock 34 and to swing upwardly about the pins 20, 22 in a vertical plane as indicated by the arrows 48, 49 (FIG. 2). Upon entering the rescue platform the worker stands upon the floor grating 50. Once clear of the gate, gravitational forces act to automatically cause the gate 6 to assume a closed position. The weight of the gate and momentum of the closing action as the gate swings oppositely to the direction indicated by the arrows 48, 49 forces member 35 to engage the lock 34. Exiting from the rescue platform would be accomplished in the same manner by first opening the gate 6 and then descending the ladder 2. Inside and outside handles 52, 53 project from the vertical gate member 12 to provide a convenient grasping location for gate opening by a workman whether standing outside of the platform 4 upon the ladder 2 or when inside the platform 4.

Although the invention has been described with a certain degree of particularity, it is understood that the present disclosure has been made only by way of example and that numerous changes in the details of construction and the combination and arrangements of parts may be resorted to without departing from the spirit and scope of the invention. Thus, the scope of the invention should not be limited by the foregoing specification, but rather only by the scope of the claims appended hereto.

What is claimed is:

1. An improved ladder supported rescue platform which comprises an extendable, movable ladder having a movable free end;

a rescue platform operably connected to said ladder at the free end thereof, said rescue platform being circumscribed by a safety railing, the safety railing having an acess opening defined therein, the access opening being located at the connection between the ladder and the platform, the platform being adapted to be moved when the ladder is moved; and a gate movable with the platform and connected to the said railing, said gate being adapted to close the access opening, said gate being adapted to move in a vertical plane between open and closed positions and to be self closing whereby the access opening defined in the safety railing when the gate is open facilitates movement between the platform and the ladder, the gate comprising a first vertical member, a movable vertical member, an upper rail having first pivotal connection at the first vertical member and a second pivotal connection to the movable vertical member, the upper rail terminating outwardly from the second pivotal connection in an elongated movable end, a lower rail having a first pivotal connection at the first vertical member and a second pivotal connection to the movable vertical member, the lower rail terminating outwardly from the second pivotal connection in a short movable end, vertical offset means to prevent contact between the upper and lower rails when the gate is moved between the said open and closed positions, and wherein a locking mechanism is affixed to the safety railing and projects into the access opening in a position to receive and to releasably lock the movable end of the upper rail and wherein a stationary member is affixed to the safety railing and projects into the access opening below the locking mechanism in a location to receive the short movable end of the lower rail, the locking mechanism being shorter in length than the stationary member and the locking mechanism projecting into the access opening a lesser distance than the stationary member, whereby a workman can safely enter the platform from the ladder by raising the gate and whereby the gate will automatically close to maintain the integrity of the safety railing.

2. The platform according to claim 1 wherein the offset means comprises a vertical offset between the first pivotal connection of the lower rail to the first vertical member and the first pivotal connection of the upper rail, to the first vertical member, the first pivotal connection of the lower rail being closer to the movable vertical member than the first pivotal connection of the upper rail.

3. An improved ladder supported rescue platform which comprises:

an extendable, movable ladder having a movable free end;

a rescue platform operably connected to said ladder at the free end thereof, said rescue platform being circumscribed by a safety railing having an access opening, the platform being adapted to be moved when the ladder is moved; and a gate forming a portion of said railing, connected to the said railing, said gate being adapted to close the access opening, said gate being adapted to move in a vertical plane between open and closed positions and to be self closing, whereby the access opening defined in the safety railing when the gate is open facilitates movement between the platform and the ladder, said gate comprising integral means to continuously urge the gate to the said closed position, the said access opening being in alignment with the ladder, the said gate comprising a parallelogram configuration, said parallelogram including a first vertical member which forms an integral portion of said platform, said first vertical member having no movement relative to the platform, the first vertical member being adapted to move with said platform, a part of the safety railing adjacent the ladder being constructed to lie in a first vertical plane and wherein the said gate is positioned to lie in a second vertical plane, said second plane being offset from the first plane, whereby a workman can safely enter the platform from the ladder by raising the gate and whereby the gate will automatically close to maintain the integrity of the safety railing.

4. The platform of claim 3 wherein the second plane is positioned inwardly from the first plane, the second plane being positioned over a part of the platform.

5. The platform of claim 4 wherein an offset link interconnects the gate and the said first vertical member.

* * * * *